US005352167A

United States Patent [19]

Ulicny

[11] Patent Number: 5,352,167

[45] Date of Patent: Oct. 4, 1994

[54] INCLINATION DRIVE MECHANISM FOR A TREADMILL

[75] Inventor: Dennis J. Ulicny, Waukesha, Wis.

[73] Assignee: ECM Motor Co., Elkhorn, Wis.

[21] Appl. No.: 74,116

[22] Filed: Jun. 8, 1993

[51] Int. Cl.[5] ..... A63B 22/02

[52] U.S. Cl. ..... 482/54; 74/89.17

[58] Field of Search ..... 482/54, 1, 4; 74/89.17, 74/422

[56] References Cited

U.S. PATENT DOCUMENTS

| | | | |
|---|---|---|---|
| 2,857,697 | 10/1958 | Schutt et al. | 74/89.17 |
| 3,733,662 | 5/1973 | Plevyak | 74/89.17 |
| 4,541,298 | 9/1985 | Strutt | 74/89.17 |
| 4,704,913 | 11/1987 | Zimmer | 74/89.17 |
| 4,715,724 | 12/1987 | Ter Beek et al. | 74/89.17 |
| 4,844,449 | 7/1989 | Truslaske | 482/54 |
| B1 4,913,396 | 4/1990 | Dalebout et al. | 482/54 |

*Primary Examiner*—Richard J. Apley
*Assistant Examiner*—Lynne A. Reichard
*Attorney, Agent, or Firm*—Dressler, Goldsmith, Shore & Milnamow, Ltd.

[57] ABSTRACT

An inclination drive mechanism for a treadmill permits driven, selective adjustment of the angle of inclination of the treadmill. The drive mechanism includes an electric motor which operates through a gear train including an output gear pinion. The gear pinion in turn drives a gear rack, which can be provided in either a linear or arcuate configuration. The mechanism includes a load-bearing support bracket on which the gear rack is mounted with the support bracket configured to minimize non-torsional loading of the gear train. The resultant construction is desirable economical and durable.

5 Claims, 4 Drawing Sheets 120
132
134
144
146
148
150
154
156
160
160'
162
162'
L
9

INCLINATION DRIVE MECHANISM FOR A TREADMILL

TECHNICAL FIELD

Present invention relates generally to a treadmill having a powered track on which a user runs or walks, and more particularly to a drive mechanism for selectively adjusting the inclination of the treadmill, including a cooperating gear pinion and driven gear rack.

BACKGROUND OF THE INVENTION

In recent years, treadmill devices have become increasingly popular to afford users the opportunity to exercise by running or walking indoors. Such devices ordinarily include a powered track, or tread, which is driven at selectively variable speeds in accordance with the speed at which the user wishes to run or walk. While treadmill devices had been available for use in health clubs and the like for some time, the versatility of use offered by such devices has made them increasingly popular for home use. As such, it is important that the devices not only be durably constructed, but also relatively economical if they are to be affordable for home use.

In this regard, one feature of such devices which enhances their versatile use is the provision of an arrangement for selectively adjusting the inclination of the treadmill. Such arrangements permit the user to vary the level of exertion during use by simulating running or walking on "level terrain" (with a low level of inclination), or "uphill" (with a high angle of inclination).

The highest degree of versatility and convenience is offered when such inclination arrangements are powered, permitting a user to effect adjustment while standing on the treadmill. As will be appreciated, however, such powered arrangements are subjected to very high loading, including impact loading when a user runs on the treadmill.

While past constructions have used ball-screw drive mechanisms for effecting powered inclination adjustment, such arrangements are not particularly economical, thereby detracting from the affordability of such treadmill devices. The present invention contemplates an inclination drive mechanism for a treadmill which is specifically configured for economical use, while providing the load-bearing characteristics necessary for reliable operation of such arrangements.

SUMMARY OF THE INVENTION

A treadmill inclination drive system embodying the principles of the present invention is configured in a desirably straightforward manner to facilitate use of commercially available subfractional horsepower motors and gear trains. This is achieved by employing a rack and pinion gear drive, with a drive mechanism including a one-piece load-bearing support bracket which desirably acts to minimize non-torsional loading of the gear train. A robust and durable, yet economical drive mechanism is thus provided, with the mechanism functioning in the nature of a linear actuator to create hundreds of pounds of force for effecting powered inclination of the treadmill.

In accordance with the illustrated embodiments, the drive mechanism is configured for selectively adjusting the inclination of a treadmill having a frame, and a support member movable relative to the frame for adjusting the angle of inclination of the treadmill. The drive mechanism includes a subfractional horsepower electric motor, and a gear train operatively connected with the electric motor which includes an output gear pinion.

The drive mechanism further includes a driven gear rack positioned in meshing engagement with the output pinion. In order to isolate non-torsional loads from the gear train and the associated gear box, the construction further includes a load-carrying support bracket, including a rack mounting element on which the gear rack is mounted and is maintained in engagement with the output gear pinion. Operative connection of the drive mechanism with the treadmill is achieved by having one of the support bracket and the gear rack connected to the frame of the treadmill, and the other of the support bracket and the gear rack connected to the movable support member of the treadmill. In this manner, operation of the electric motor acts through the gear train to move the gear rack relative to the support bracket, thereby moving the movable support member relative to the treadmill frame for adjusting the inclination of the treadmill.

In one form of the invention, the gear rack of the drive mechanism comprises a linear gear rack which moves in a linear fashion relative to the associated support bracket. In order to maintain the linear gear rack in meshing engagement with the gear pinion, the rack mounting element of the support bracket has a generally L-shaped cross-sectional configuration for holding the linear gear rack in captive, sliding relationship between the rack mounting element and the surface of the support bracket. Thus, the rack mounting element of the support bracket is configured as a channel-like portion of the bracket, with the linear gear rack generally slidably movable therein. In the preferred form, the support bracket further includes an elongated guide slot, with the gear rack including a guide pin movable within the guide slot for further guiding and mechanically limiting linear movement of the rack relative to the support bracket.

In an alternate embodiment of the invention, an arcuate gear rack, in the form of a sector gear, is provided for driven engagement with the output gear pinion. In this embodiment, the support bracket maintains the arcuate gear rack in meshing engagement with the output gear pinion by the provision of a rotatable mounting element which rotatably mounts the arcuate gear rack on the support bracket.

The provision of the rack mounting element, as a channel-like portion or as a rotatable mounting element, desirably directs loads from the gear rack (either linear or arcuate) into the mounting element. In order to minimize and isolate such non-torsional loads from the motor-driven gear train, the gear train is provided with an output bearing which rotatably supports the output gear pinion. The support bracket is positioned in engagement with the output bearing thus acting to isolate the gear train from non-torsional loading.

Other features and advantages of the present invention will become readily apparent from the following detailed description, the accompanying drawings, and the appended claims.

DETAILED DESCRIPTION

Figure 2:
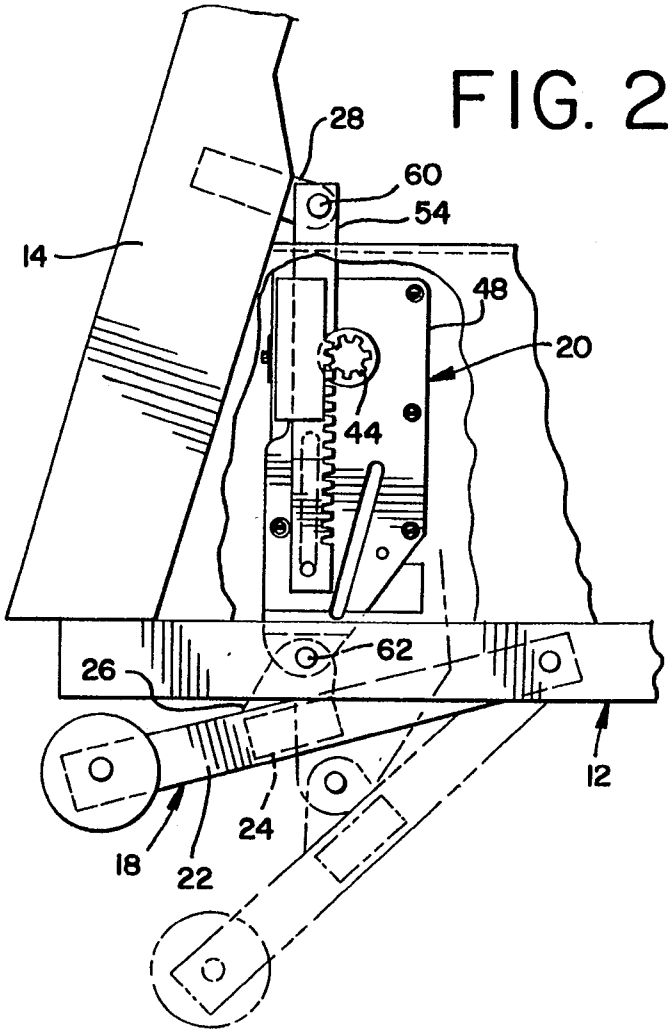
FIG. 2 is a side elevational view, partially cut away, illustrating the inclination drive mechanism of the present invention in association with the treadmill of FIG. 1.

While the present invention is susceptible of embodiment in various forms, there is shown in the drawings and will hereinafter be described presently preferred and alternate embodiments of the present invention, with the understanding that the present disclosure is to be considered as exemplification of the invention, and is not intended to limit the invention to the specific embodiments illustrated.

Figure 1:
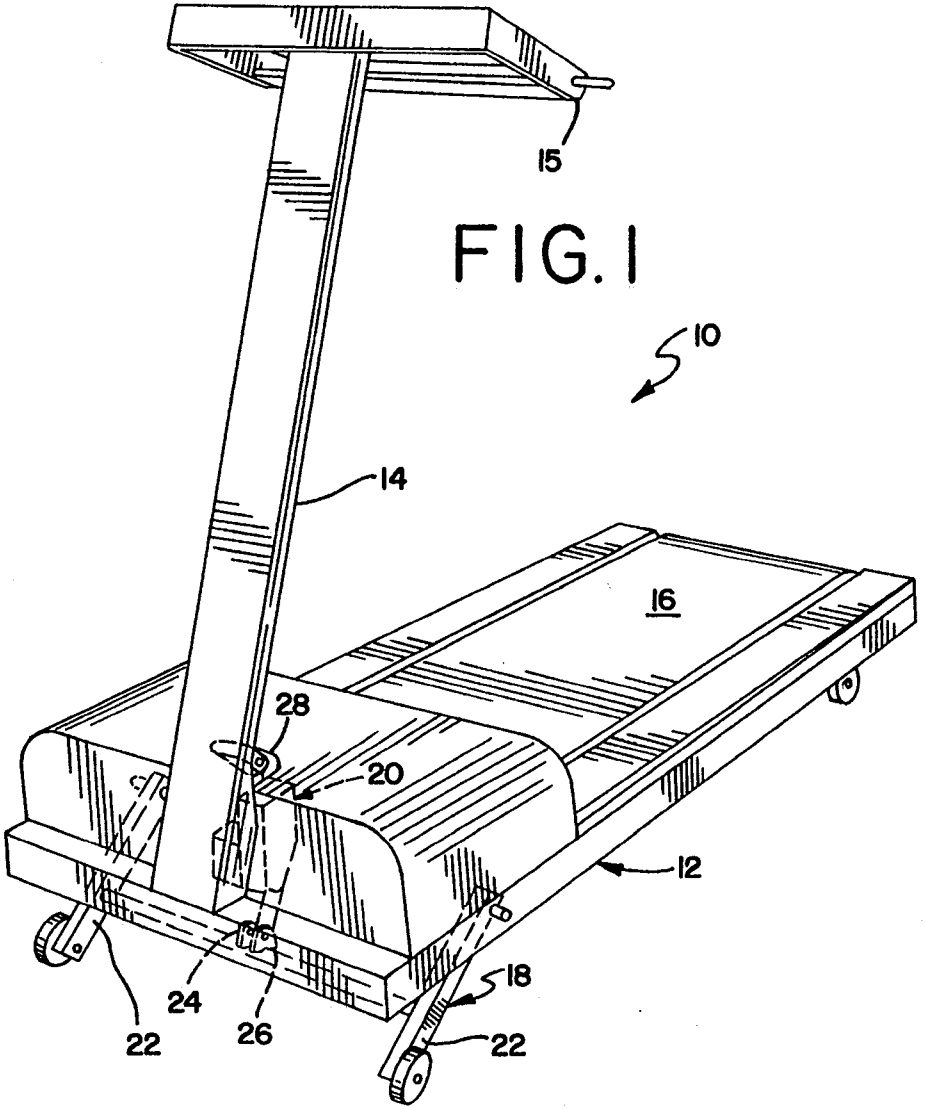
FIG. 1 is a front perspective view of a treadmill including an inclination drive mechanism embodying the principles of the present invention.

With reference first to FIGS. 1 and 2, therein is illustrated a treadmill 10 including an inclination drive mechanism embodying the principles of the present invention. The treadmill 10 includes a frame 12 having an upright 14 on which a control panel 15 is mounted for operation by a user. The treadmill includes a powered track 16 movably mounted on the frame for supporting a user during walking or running on the treadmill.

Selective adjustment of the inclination of the treadmill is effected through selective pivotal movement of a movable support member 18 positioned generally beneath frame 12. The support member 18 is operatively connected with a drive mechanism 20, embodying the principles of the present invention, which is provided in the form of a linear actuator. More specifically, the support member 18 includes a pair of support legs 22, each pivotally connected to the frame 12, and each provided with a ground-engaging roller thereon. A cross-brace 24 extends between the support legs 22, with the cross-brace in turn provided with a clevis 26 for operative connection with the drive mechanism 20. The drive mechanism 20 is further connected with the frame of the treadmill by an upper clevis 28.

Figure 3:
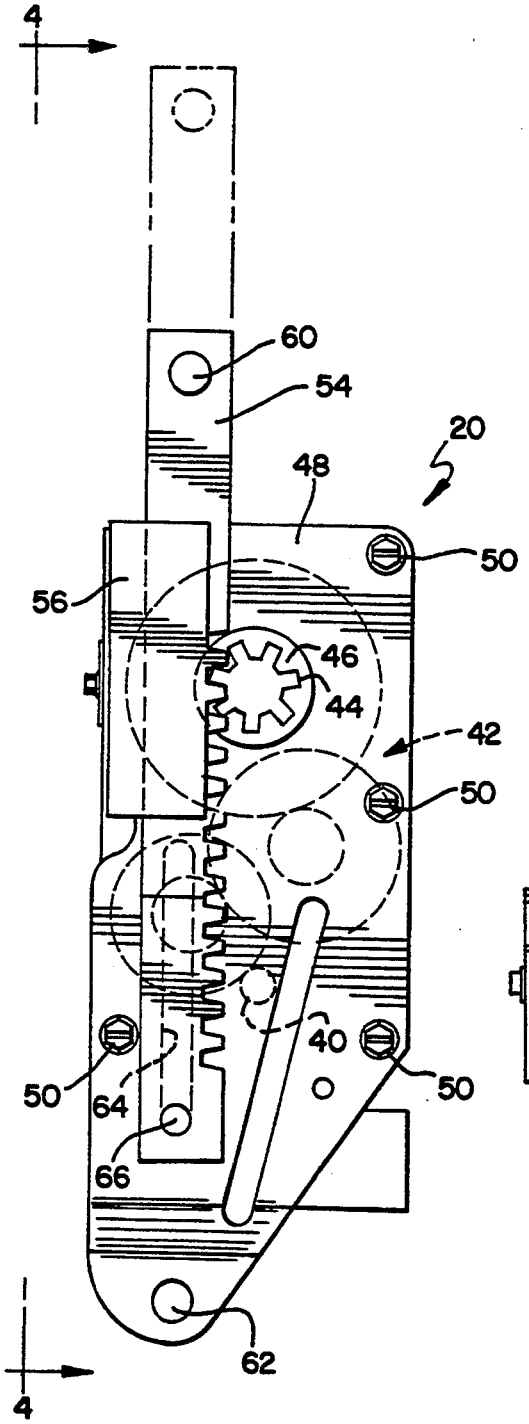
FIG. 3 is a side elevational view of the drive mechanism shown in FIG. 2.
Figure 4:
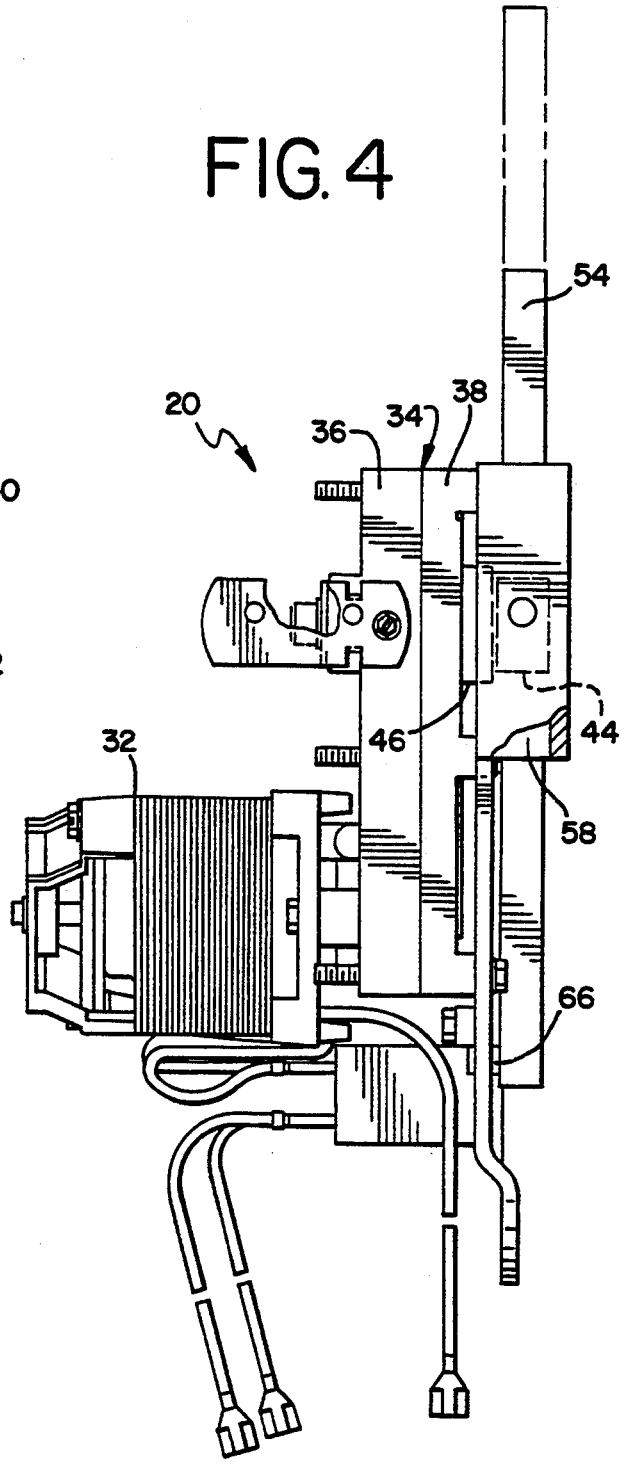
FIG. 4 is a front elevational view of the drive mechanism shown in FIG. 3.

With particular reference to FIGS. 2–4, drive mechanism 20 will now be described in detail. The drive mechanism includes an electric motor 32, which can be of the so-called subfractional horsepower type for desirably economical use. The electric motor is suitably wired for reversible operation, such as from control panel 15. The electric motor 32 is mounted on a gear box 34, which in this embodiment includes a base portion 36 and a cover portion 38 (see FIG. 4).

As illustrated in phantom line in FIG. 3, the motor 32 includes a pinion 40 which is operatively connected with a gear train 42 (enclosed by the base and cover portions 36 and 38) for effecting torque-multiplication. In a typical construction such as illustrated, a three-stage gear reduction is provided, with the gear train including an output gear pinion 44 for delivering relatively low speed, high-torque driving rotational movement. In a current embodiment, an electric motor and gear box/gear train unit available from ECM Motor Co., of Elkhorn, Wis., has been successfully employed (type D9C, with a cone brake). While it will be appreciated that other types of motors and gear trains can be employed, a particularly desirable feature of the present drive mechanism is its suitability for use with relatively low-cost, readily available electric motors and gear trains such as designated above.

Rotatable support for the output gear pinion 44 is provided by an output bearing 46 of the gear train which is mounted in the gearbox 34. In order to isolate the gear train from non-torsional loading (the gear train is specifically designed and well-suited to handle torque-loads) a particularly desirable feature of the present drive mechanism includes the provision of a load-bearing support bracket 48 which is positioned to abut and engage the output bearing 46 for transferring non-torsional loans therebetween. To this end, the support bracket 48 is connected by suitable fasteners 50 to the gear box 34.

In order to effect movement of the treadmill support member 18 relative to the frame 12, the drive mechanism 20 includes a linear gear rack 54 mounted on the support bracket 48. To this end, the support bracket is preferably of unitary or one-piece construction, including an integral rack mounting element 56. The rack mounting element 56 projects forwardly from the surface of the support bracket 48, and has a generally L-shaped cross-sectional configuration to hold the gear rack 54 in captive, sliding relationship between the mounting element and the surface of the support bracket. The mounting element is thus provided in the form of a channel-like portion of the support bracket for sliding movement of the gear rack 54 therein. In the preferred embodiment, a relatively low-friction guide member 58 (shown in cutaway in FIG. 4) is positioned generally within the rack mounting element for guiding relative sliding movement of the linear gear rack 54. In a current embodiment, guide element 58 is formed from Delrin, an acetal homopolymer. Other suitable durable, low-friction materials can be employed.

As will be appreciated, the mounting element 56 of the support bracket tends to receive and transfer loads from the gear rack to the support bracket, which loads would otherwise tend to move the gear rack out of engagement with the output gear pinion 44. In turn, non-torsional loads (i.e., loads transverse to the axis of pinion 44) are transferred from the support bracket to the output bearing 46, thereby desirably acting to minimize non-torsional loading of the gear train.

One of the support bracket 48 and gear rack 54, is connected to the frame of the treadmill (specifically, gear rack 54 is connected to upper clevis 28 at upper mount 60), while the other of the support bracket and gear rack is connected to the movable support member 18 (specifically, support bracket 48, by connection to lower clevis 26 at lower mount 62).

The relative linear movement of the gear rack 54 is further guided and supported by the preferred provision of a guide slot 64 defined by the support 48. The linear gear rack 54 includes a guide pin 66 movable within the guide slot 64 for guiding and mechanically limiting the linear movement of the gear rack relative to the support bracket.

Figure 5:
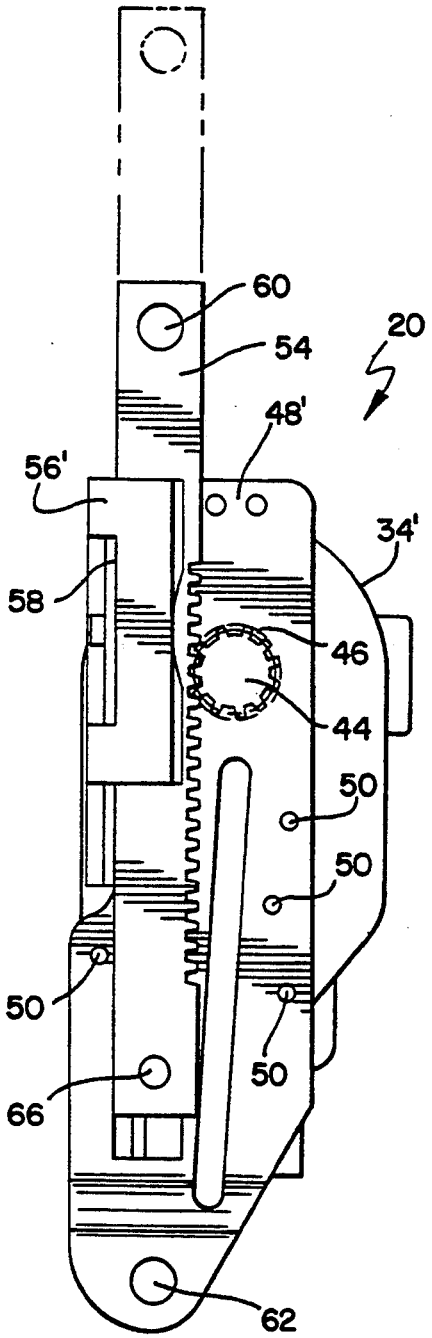
FIG. 5 is a side elevational view of a modified embodiment of the present drive mechanism.
Figure 6:
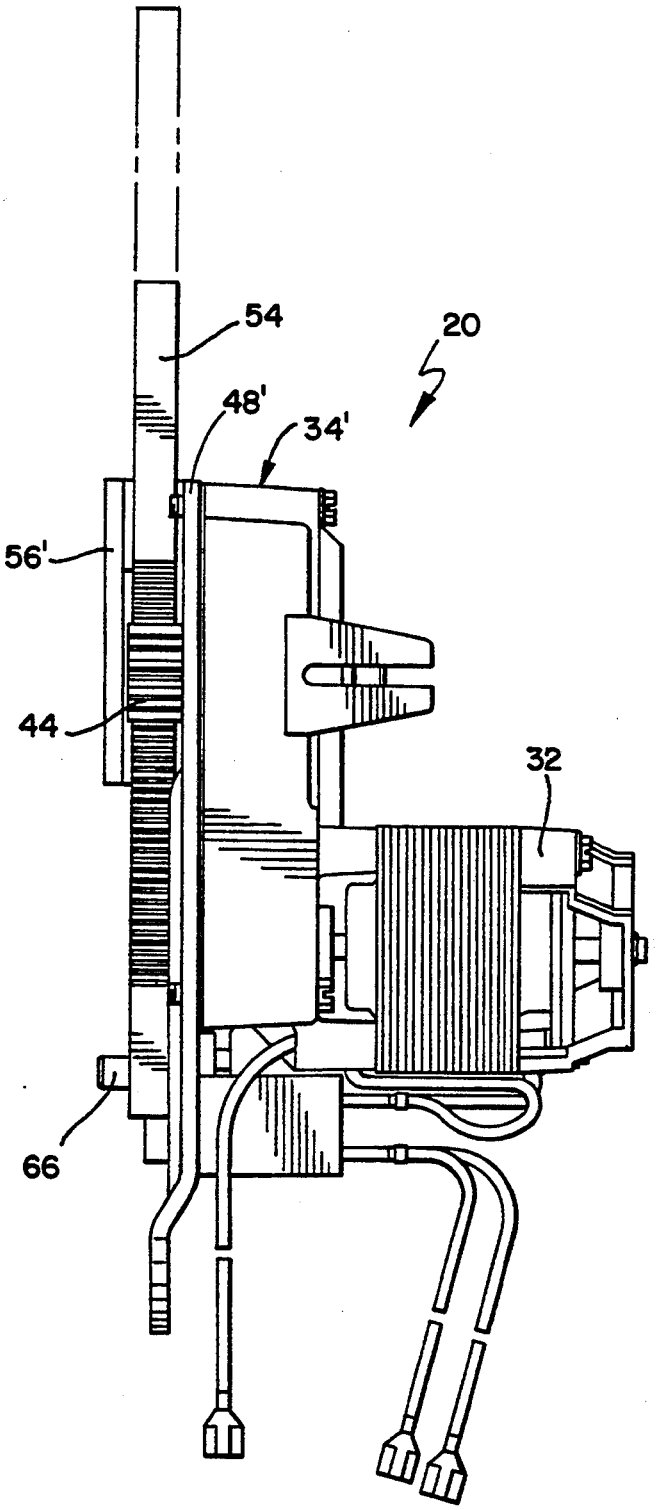
FIG. 6 is a rear elevational view of the drive mechanism shown in FIG. 5.

A modified embodiment of the drive mechanism 20 of the present invention is illustrated in FIGS. 5 and 6. In most respects, this modified embodiment is like the previously described arrangement. However, this embodiment differs from the previously described construction in that a support bracket 48' is provided which generally replaces and takes the place of gear box cover portion 38. Thus, the illustrated gear box 34' for enclosing the gear train, includes a base portion, with the support bracket 48' being mounted on the base portion for enclosing the gear train together with the base portion. In contrast, in the previous embodiment, the base portion 36 and cover portion 38 of the gear box together enclose the drive train, with the support bracket 48 mounted thereon.

Figures 7, 8, 9:
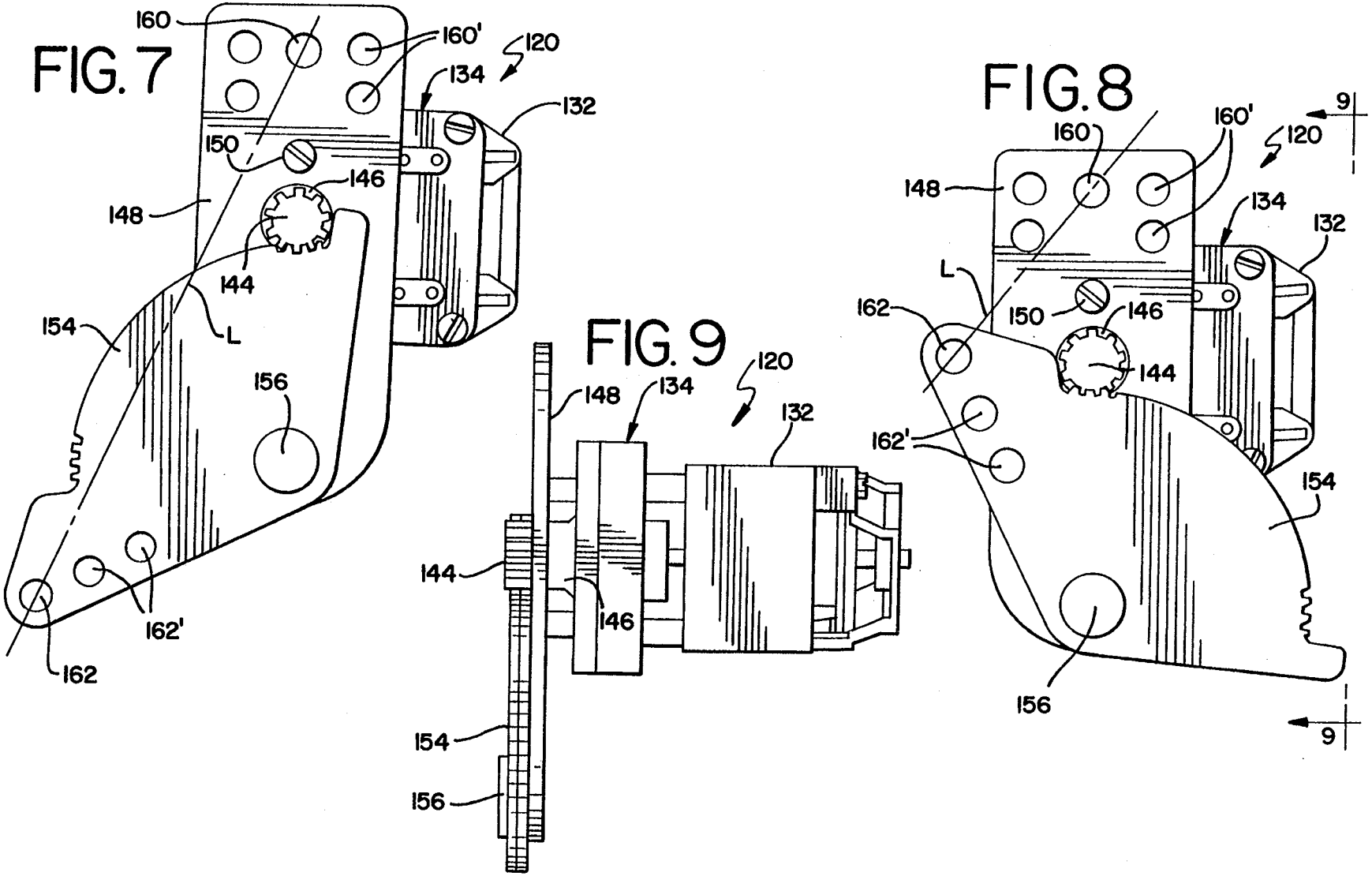
FIG. 7 is a side elevational view of an alternative embodiment of the present inclination drive mechanism, illustrated in an extended condition.
FIG. 8 is a view similar to FIG. 7, illustrating the drive mechanism in a non-extended or retracted position.
FIG. 9 is a view taken generally along line 9—9 of FIG. 8.

FIGS. 7–9 illustrate an alternate embodiment of the present drive mechanism, with elements which correspond to the previously described embodiment so-designated by like reference numerals in the one-hundred series.

The illustrated drive mechanism 120 includes an electric motor 132 which operates through a gear train enclosed within a gear box 134, which effects suitable torque-multiplication of the motor output. The gear train includes an output gear pinion 144, rotatably supported by an associated output bearing 146.

As in the previous embodiment, the construction includes a load-carrying support bracket 148 which is configured to abut and engage the output bearing 146 for transfer of non-torsional loads therebetween. Suitable fasteners 150 secure the support bracket to the gear box.

In distinction from the previous embodiment, drive mechanism 120 includes an arcuate gear rack 154, in the form of a sector gear. The arcuate gear rack 154 is rotatably mounted on the support bracket 148, and is maintained in an engagement with the output gear pinion 144 by a rotatable mounting 156.

As in the previous embodiment, one of the support bracket 148 and arcuate gear rack 154 is connected to the frame of the treadmill (such as by connection of the support bracket at 160), while the other of the bracket and gear rack is connected to the movable support 18 of the treadmill (such as by connection of the gear rack at 162). However, it will be noted that this embodiment of the present drive mechanism is particularly preferred for its compact dimensioning. Although this embodiment is readily capable of providing a "stroke" of actuation (along line of action L) comparable to the previously described embodiment, the overall construction is far more compact, with the relatively compact non-extended or retracted condition of the drive mechanism illustrated in FIG. 8. Versatility of application is thus enhanced. Versatility is further enhanced by the optional provision of a plurality of mounting holes, designated at 160' in support bracket 148, and at 162' in the arcuate gear rack 154. The provision of a plurality of such holes, for selectively varying the point in which the drive mechanism is operatively connected with associated components, readily permits the drive force, and stroke of movement, generated by the mechanism to be selected as necessary for a specific application.

In a current embodiment, a motor 132 and associated gear train/gear box 134 available from ECM Motor Co. has been successfully employed (type D1HC).

From the foregoing, it will be observed that numerous modifications and variations can be effective without departing from the true spirit and scope of the novel concept of the present invention. It will be understood that no limitation with respect to the specific embodiments disclosed herein is intended or should be inferred. The disclosure is intended to cover by the appended claims all such modifications as fall within the scope of the claims.

What is claimed is:

1. An inclination drive mechanism for selectively adjusting the inclination of a treadmill, said drive mechanism comprising:

an electric motor;

a gear train operatively connected to said electric motor and including an output gear pinion and an output bearing for rotatably supporting said output gear pinion, said gear train being enclosed within a gear box connected to said electrical motor;

a driven linear gear rack positioned in meshing engagement with said output pinion; and a load-carrying support bracket connected to said gear box and including a rack mounting element comprising a channel-like portion of said support bracket generally within which said gear rack is mounted on said support bracket and is maintained in engagement with said gear pinion, said support bracket being positioned in engagement with said output bearing to transfer non-torsional loads exerted on said support bracket by said linear gear rack from said support bracket to said output bearing, said support bracket and said gear rack being connected to the treadmill for selectively adjusting its inclination, so that operation of said electric motor acts through said gear train to move said gear rack relative to said support bracket for adjusting the inclination of the treadmill.

2. An inclination drive mechanism in accordance with claim 1, wherein said rack mounting element having a generally L-shaped cross-sectional configuration for holding said linear gear rack in captive sliding relationship between said rack mounting element and a surface of said support bracket.

3. An inclination drive mechanism in accordance with claim 2, including a relatively low-friction guide member positioned generally within said rack mounting element for guiding relative sliding movement of said linear gear rack.

4. An inclination drive mechanism in accordance with claim 2 wherein said support bracket defines an elongated guide slot, and said linear gear rack includes a guide pin movable within said guide slot for guiding and limiting linear movement of said gear rack relative to said support bracket.

5. An inclination drive mechanism in accordance with claim 1, including said gear box including a base portion, and a cover portion positioned adjacent said base portion for enclosing said gear train, said support bracket being mounted on said gear box adjacent to said cover portion.

* * * * *